United States Patent [19]

Jean-Frederic

[11] 4,313,095

[45] Jan. 26, 1982

[54] MICROWAVE CIRCUIT WITH COPLANAR CONDUCTOR STRIPS

[75] Inventor: André Jean-Frederic, Paris, France

[73] Assignee: Thomson-CSF, Paris, France

[21] Appl. No.: 119,563

[22] Filed: Feb. 7, 1980

[30] Foreign Application Priority Data

Feb. 13, 1979 [FR] France ..... 79 03641

[51] Int. Cl.[3] ..... H01P 1/203; H01P 5/12; H01P 5/18; H01P 9/00

[52] U.S. Cl. ..... 333/116; 333/128; 333/161; 333/204

[58] Field of Search ..... 333/116, 121, 128, 161, 333/203, 204, 238, 246

[56] References Cited

U.S. PATENT DOCUMENTS

| | | | |
|---|---|---|---|
| 3,516,024 | 6/1970 | Lange | 333/116 |
| 3,560,893 | 2/1971 | Wen | 333/116 X |
| 3,736,534 | 5/1973 | Chaffee | 333/161 |
| 3,990,024 | 11/1976 | Hou | 333/238 X |
| 4,130,723 | 12/1978 | Wakeling | 333/238 X |
| 4,186,352 | 1/1980 | Hallford | 333/238 X |

FOREIGN PATENT DOCUMENTS

| | | | |
|---|---|---|---|
| 2457644 | 7/1975 | Fed. Rep. of Germany | 333/116 |

*Primary Examiner*—Paul L. Gensler
*Attorney, Agent, or Firm*—Karl F. Ross

[57] ABSTRACT

A microwave circuit has a flat dielectric substrate with one face carrying a grounded metallic layer partly broken away to leave room for a multiplicity of conductor strips coplanar therewith which form part of one or more transmission lines having input and output ends each comprising an ungrounded strip portion flanked by two zones of the grounded layer. Electrical continuity between separated portions of that layer, and/or between nonadjacent conductor strips, is established by short-circuiting wires jumping across intervening strip sections. With coupled transmission lines operating with different modes of propagation, this structure substantially equalizes their respective phase velocities.

16 Claims, 8 Drawing Figures

MICROWAVE CIRCUIT WITH COPLANAR CONDUCTOR STRIPS

FIELD AND BACKGROUND OF THE INVENTION

My present invention relates to a microwave circuit with coplanar conductor strips.

An important application of such a circuit is in monolithic or hybrid microelectronics, such as for example interdigitated filters.

The electrical state of two coupled transmission lines functioning with transverse electromagnetic waves can be represented at any time by two propagation modes superimposed on each transmission line.

A first mode, called the even mode, is characterized by pairs of conductors with cophasal voltage and current values (E, I) in any cross-sectional plane of each line; a second mode, called the odd mode, is characterized by pairs of conductors whose voltage and current values (E, I) are in phase opposition in any such cross-sectional plane. In the case of a line produced by microstrip technology, i.e. constituted by conducting strips arranged on the same face of a dielectric substrate whose other face is covered by a conductive layer known as a ground plane, the phase velocity of one mode involving propagation between one conducting strip and the ground plane (even mode) cannot be equal to the phase velocity of a mode involving propagation between two adjacent conducting strips (odd mode). Thus, in the first case propagation takes place almost exclusively through the substrate and in the second case a significant fraction of the energy is propagated in air, so that the very presence of the substrate makes the propagation medium nonhomogeneous. As a result, the equivalent electrical diagrams of the coupled lines become very complex or can but roughly approximate the actual conditions.

Various solutions have been proposed for homogenizing the dielectric and consequently reducing the variation between the phase velocities of the different propagation modes.

The Podell coupler described in Microwaves Magazine, March 1974, pp. 58 to 62 decreases the phase velocity in the odd mode without modifying the phase velocity in the even mode. However, this type of coupler cannot be used for coupling above 8 dB.

The overlay coupler described in the publication of IEEE Transactions on M.T.T., vol. 18, No. 4, April 1970, pp. 222 to 228 requires a transfer of dielectric material to the circuit and is difficult to realize, owing to the complicated procedure required for identically repeating the technical characteristics of couplers of this type.

Another solution, described by B. Schiek, J. Kohler and W. Shilz in the report of the 6th European Microwave Conference of 14–17 September 1976, published by Microwave Exhibitions and Publishers, Ltd., Temple Gate House, 36 High Street, Sevenoaks, Kent, TN 13 15G, England, comprises compensating the phase-velocity divergence of the even and odd modes by a stepped line construction having two coupled line sections with substantially the same length but different coupling factors due to their different spacings. This solution has the disadvantage of requiring complex calculations for its realization and, furthermore, does not make it possible to obtain, in its application to a Schiffman cell, an operation of the device on a frequency band higher than one octave.

OBJECTS OF THE INVENTION

An object of my present invention is to obviate the disadvantages referred to hereinbefore and to provide a microwave circuit with coupled lines for which the phase velocities of the different modes are brought close together.

Another object of the present invention is the provision of improved microwave circuits with both broadband and narrow-band coupled lines.

My invention further aims at greatly reducing the dimensions of such microwave circuits.

SUMMARY OF THE INVENTION

A microwave circuit according to my invention comprises a dielectric substrate with a flat face carrying on one area thereof a grounded metallic layer and on another area thereof a multiplicity of conductor strips framed by that layer and coplanar therewith. These conductor strips are part of one or more transmission lines which, pursuant to a feature of my invention, terminate at an edge of the substrate in an ungrounded central conductor which is coplanar with two flanking zones of the metallic layer.

Pursuant to another feature of my invention, a plurality of mutually coupled transmission lines formed by the aforementioned conductor strips each include at least one such conductor strip spacedly interposed between two bracketing conductor strips of another of these transmission lines, the bracketing conductor strips being conductively interconnected at both ends. The connection between at least one pair of these strip ends can be a short-circuiting wire jumping across the interposed conductor strip of the other line. Such a connection, however, can also be made with the aid of a short-circuiting transverse strip section.

In like manner, one or more ground strips can be spacedly interleaved with the conductor strips of the transmission line or lines, each such ground strip having two ends connected to the metallic layer either integrally or through a short-circuiting wire jumping across another strip.

BRIEF DESCRIPTION OF THE DRAWING

The above and other features of my invention will now be described in greater detail with reference to the attached drawing wherein.

DETAILED DESCRIPTION

Figure 1:
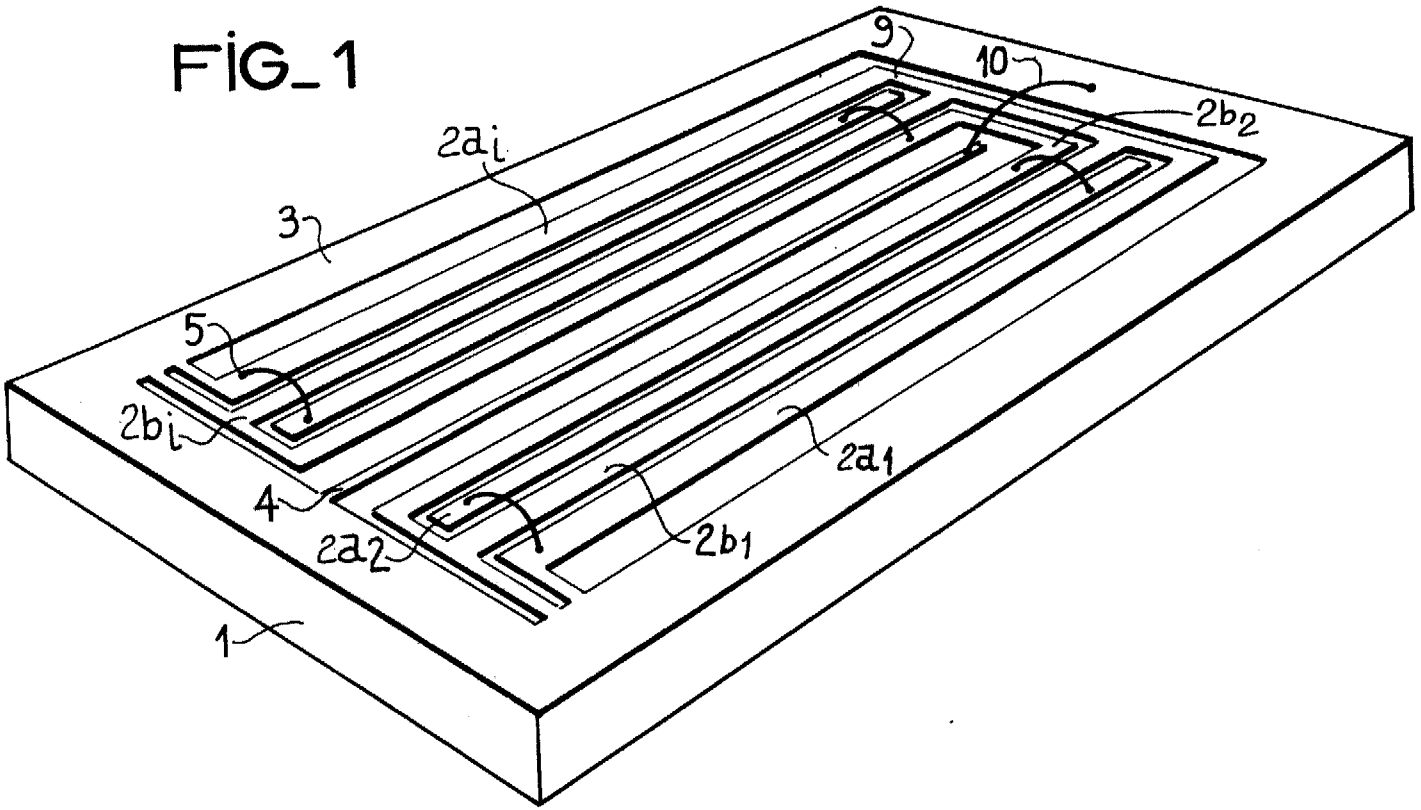
FIG. 1 is a perspective view of an assembly of coplanar coupled lines according to my invention.

Identical or equivalent elements in the various views of the drawing are given the same reference characters.

According to FIG. 1, a microwave circuit with coupled lines according to my invention comprises a dielectric substrate plate 1 on which there are provided two coupled transmission lines propagating a transverse electromagnetic mode. These lines comprise several conductor strips $2a_1$, $2a_2$, . . . $2a_i$ and $2b_1$, $2b_2$, . . . $2b_i$ framed by a common conductor 3. The partly cut-away metal layer serving as the grounded conductor 3 has an integral extension in the form of a strip 4 inserted between the two groups of line-forming strips $2a_1$ etc. and $2b_1$ etc.

The conducting strips $2a_1$—$2a_i$, $2b_1$—$2b_i$ and 4 are parallel to one another and are separated by gaps whose widths depend, like the number and arrangement of the strips, on the radio-frequency characteristics of the circuit in question and consequently on the coupling factor desired between the several transmission lines.

The mutually parallel conducting strips of each group, which constitute with parts of the ground conductor 3 a transverse-electromagnetic (TEM) transmission line, are interconnected in pairs by conducting wires or jumpers 5 and by transverse strip sections 9 forming a short circuit; the free end of strip 4 is connected to the grounded conductor 3 by a similar jumper 10. All the conducting strips of the circuit can be produced by metallization, comprising for example a resistive coating of nickel and chromium and a conductive gold coating, the respective conductivities of nickel, chromium and gold being $16 \cdot 10^6 \Omega^{-1} \cdot m^{-1}$, $6.5 \cdot 10^6 \Omega^{-1} \cdot m^{-1}$ and $49 \cdot 10^6 \Omega^{-1} \cdot m^{-1}$.

In such a circuit, the various propagation modes existing between the conductor strips are of the TEM or quasi-TEM type and the practical realizations have shown that all the parasitic modes which can exist therein are at very low levels compared with the principal TEM mode, thus permitting the design of selective components as filters.

Figure 2:
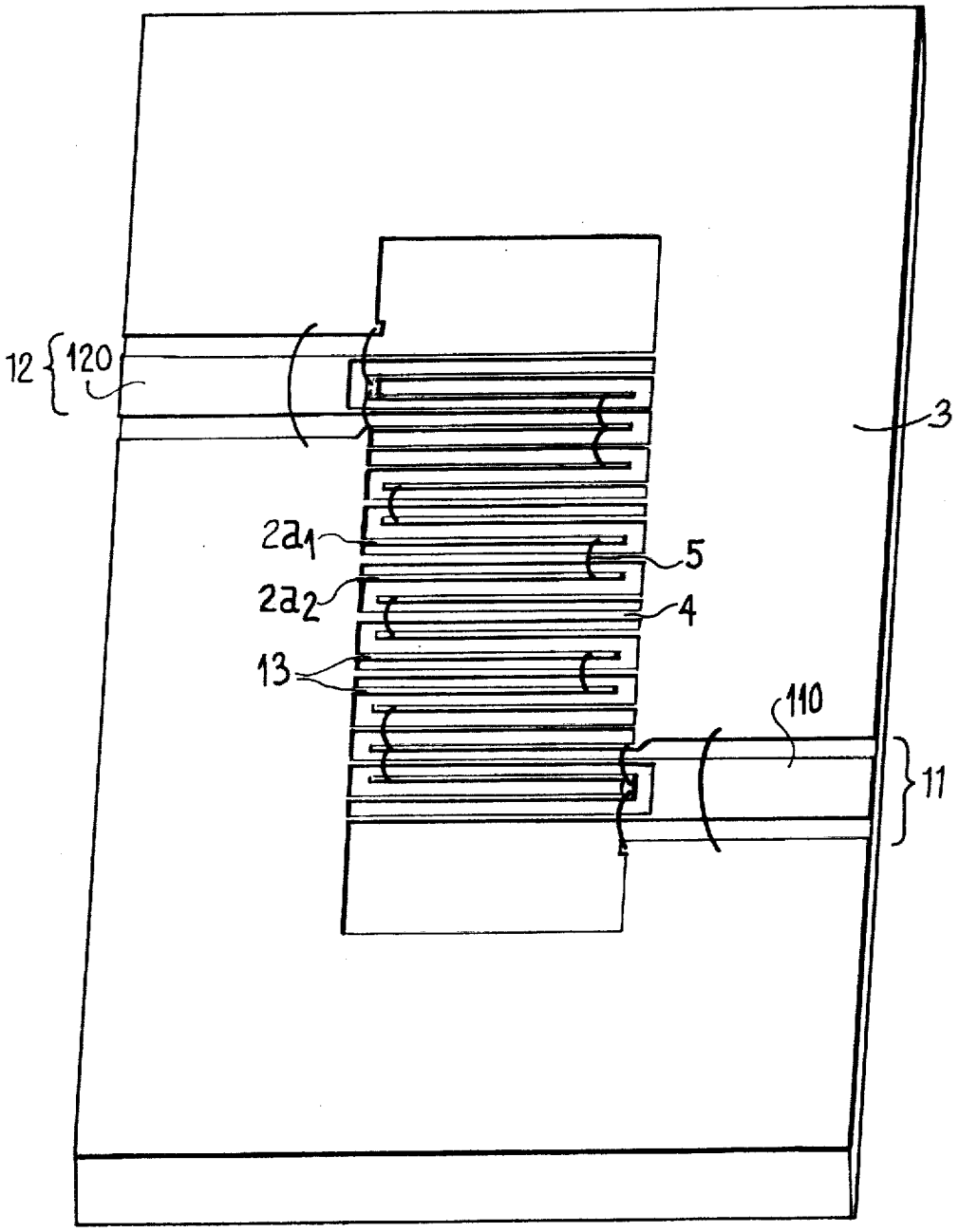
FIG. 2 is a face view of a microwave filter according to my invention.

An example of an application of this type of microwave circuit with coplanar coupled lines according to my invention is given in FIG. 2 which shows an interdigitated microwave filter. This filter comprises six coupled transmission lines, generally designated 13, in addition to an input line 11 and an output line 12 respectively constituted by a central conductor 110 or 120 each flanked by two zones of ground conductor 3. To regulate the capacitances per unit length between the several lines and the capacitances per unit length between these lines and the common conductor, each TEM line 13 is constituted by two conducting strips $2a_1$, $2a_2$ which are arranged on either side of a ground strip 4 integral with common conductor 3 and have free ends interconnected by a conducting wire 5 ensuring equipotentiality at locations remote from conductor 3 to which their opposite ends are joined. Central conductors 110 and 120 are seen to be substantially wider than any of the strips of lines 13.

Figure 3:
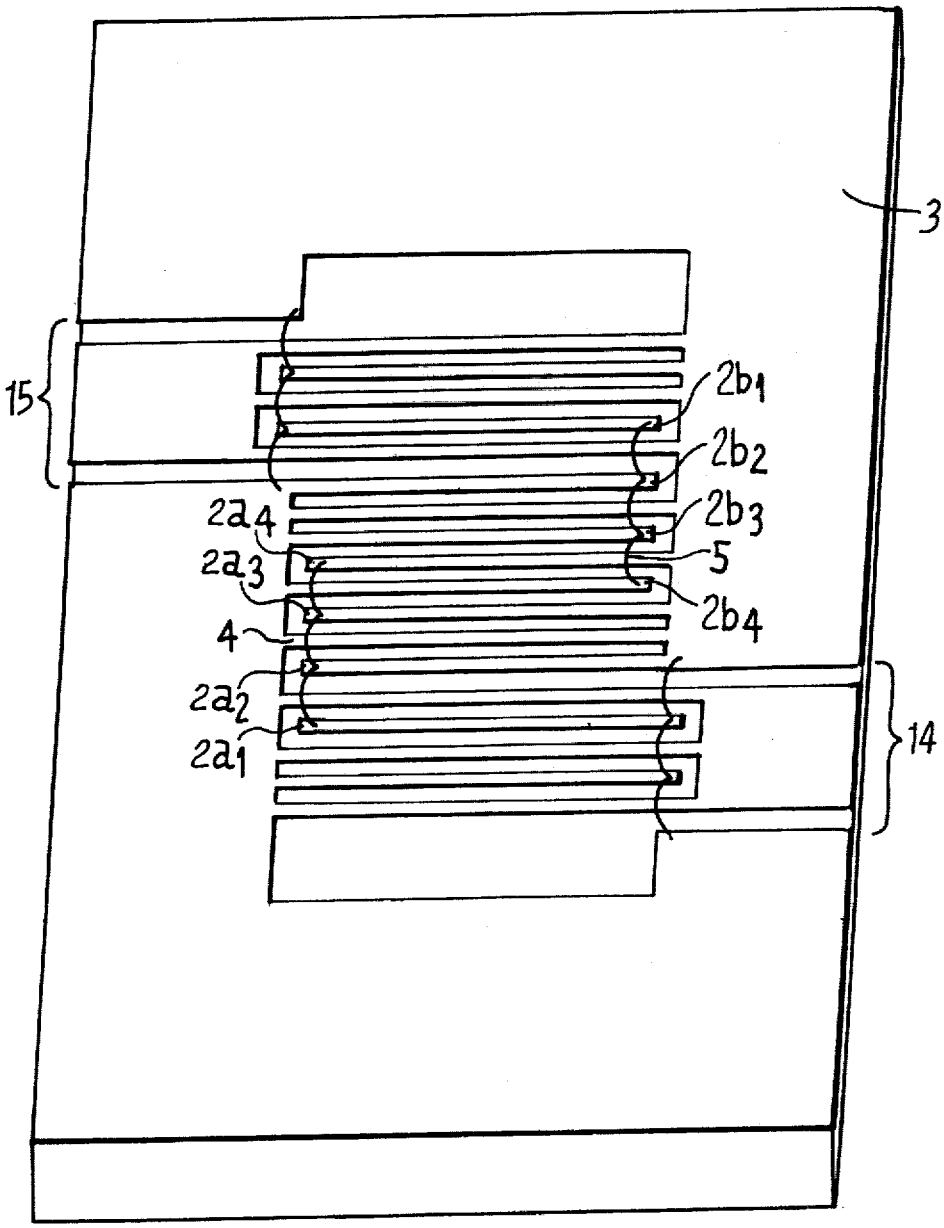
FIG. 3 is a face view of another type of microwave filter according to my invention.

FIG. 3 illustrates another embodiment of my invention constituting a very-wide-band interdigitated microwave filter with two transmission lines in addition to an input line 14 and an output line 15. Each of these transmission lines is constituted by four conductive strips $2a_1$-$2a_4$ and $2b_1$-$2b_4$ with free extremities interconnected by conducting wires 5 jumping across intervening ground strips 4. The strips $2a_3$, $2a_4$ of one transmission line and $2b_3$, $2b_4$ of the other transmission line are interleaved for coupling reasons. Similar interleaving exists between lines 14 and $2a_1$-$2a_4$ as well as between lines 15 and $2b_1$-$2b_4$. Here again, the conducting wires 5 can be replaced by transverse strip sections forming a short circuit between free ends of neighboring strips of the same line, provided that ground strips 4 are foreshortened and linked with layer 3 by jumpers 10 as shown in FIG. 1.

By way of example, for a central pass-band frequency of 5.535 GHz and a bandwidth of 39.2%, the width of the conducting strips is between 100 and 200$\mu$ and the distance between these strips is between 100 and 200$\mu$, giving as the overall dimensions of the filter approximately 11 mm by 6 mm.

Figure 4:
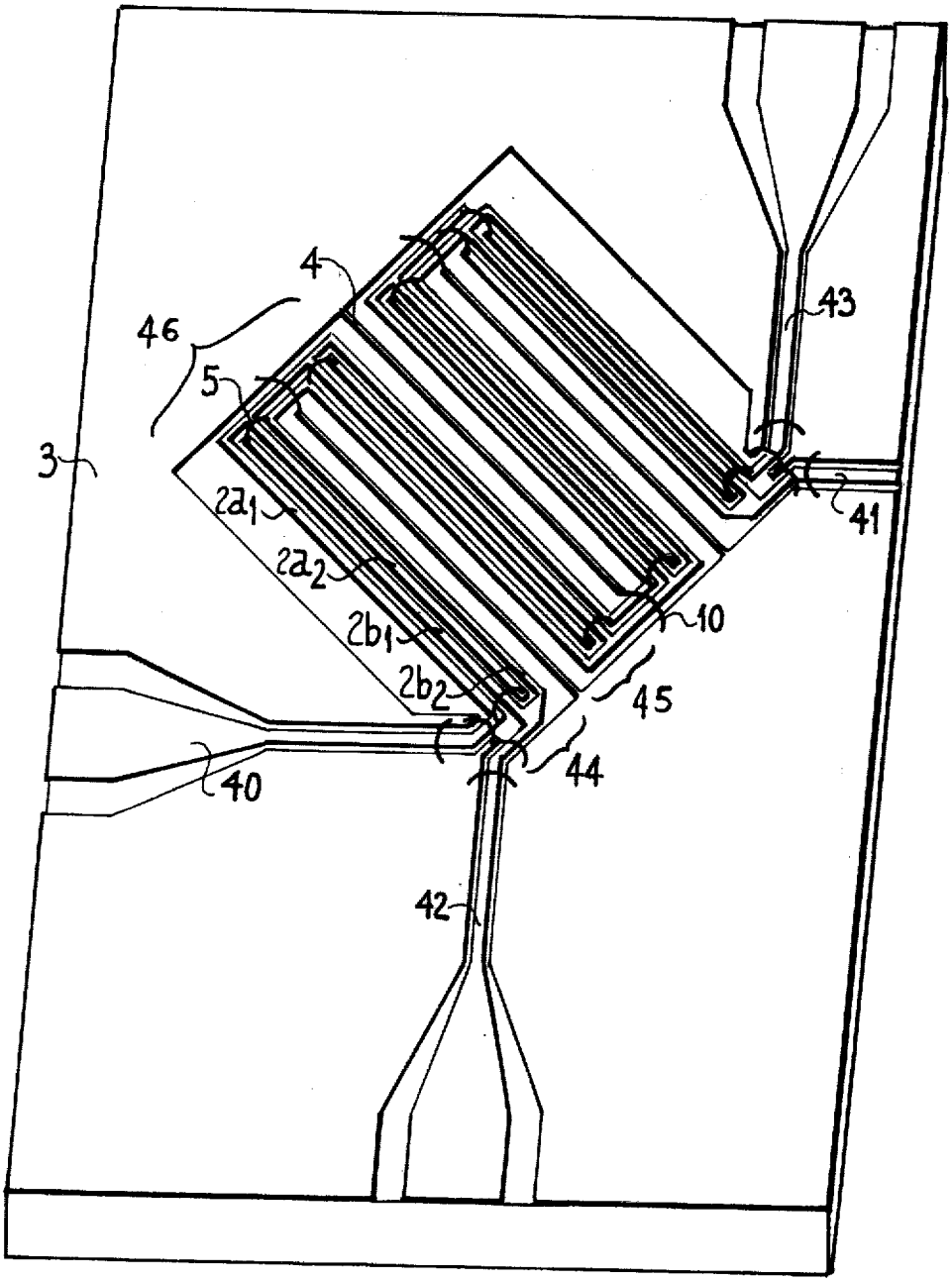
FIG. 4 is a face view of a directional coupling according to my invention.

FIG. 4 shows an application of my improved microwave circuit to a directional coupler with two coplanar transmission lines coupled together on the same dielectric substrate. An input channel 40 and a coupled channel 42 are located on one side of the circuit whereas a direct output channel 41 and a directional channel 43 are on the opposite side.

The transmission lines joining the input channel 40 to the direct output channel 41 on the one hand and the coupled channel 42 to the directional channel 43 on the other hand are constituted by the common grounded conductor 3 and by two ungrounded conductors bent into meanders 46 around three ground strips 4 integral with conductor 3. These ground strips extend alternately from opposite edges of a substantially rectangular cutout of layer 3, each such strip having a free end linked with that layer by a wire 10 jumping across transverse strip sections of the meandering conductors disposed in that cutout.

Each meander comprises two arms 44 and 45 constituted by interdigitated conducting strips $2a_1$, $2a_2$ etc. and $2b_1$, $2b_2$ etc. Two strips of one line bracketing a strip of the other line are integrally interconnected at one end and short-circuited by jumpers 5 at their opposite ends. The spacing of these arms from each other, and from the intervening ground strip 4, is seen to be substantially greater than the strip spacing within each arm.

By way of example, for a central operating frequency of 1.3 GHz, the width of the conducting strips is between 100 and 200$\mu$ and the distance between the strips is between 50 and 280$\mu$, giving as the overall dimensions for the coupler approximately 6 mm by 6.3 mm.

Figure 5:
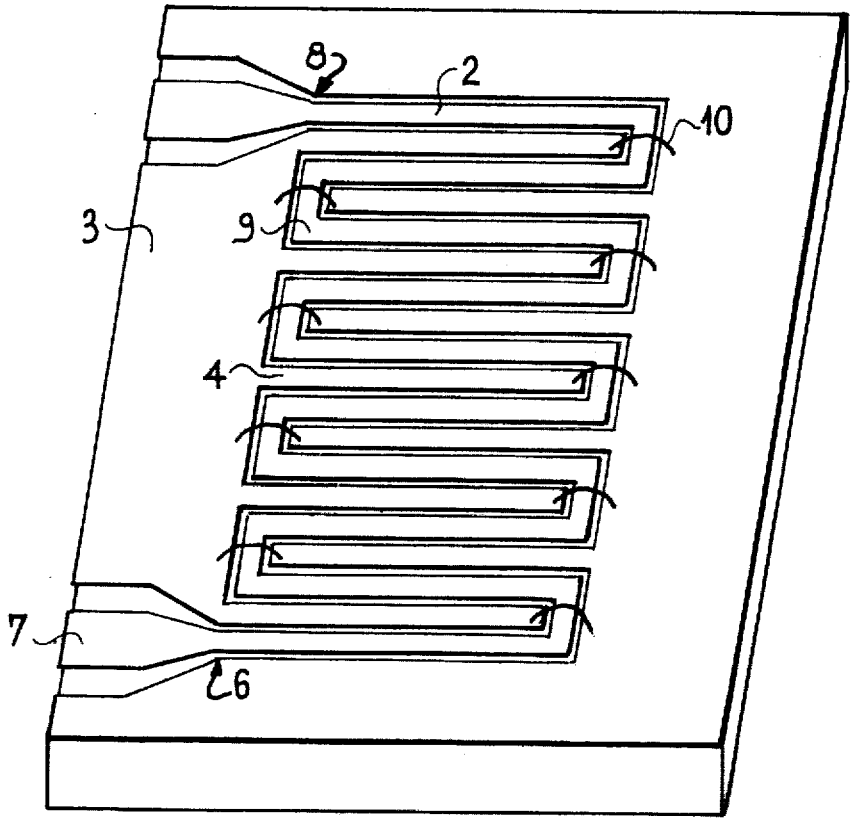
FIG. 5 is a perspective view of a coplanar delay line according to my invention.

A special case of a microwave circuit according to my invention is that comprising a single transmission line constituted by a plurality of interconnected conducting strips and a common conductor forming a meandering delay line as shown in FIG. 5. The delay line comprises an input termination 6, constituted by a central conductor 7 between two coplanar zones of the grounded conductor 3, an output termination 8 of similar shape, and mutually parallel conducting strips 2 alternately interconnected at opposite ends by short-circuiting strip sections 9. Conducting wires 10 connect the free ends of ground strips 4, bracketed by the interconnected strips 2, to the surrounding conductor 3.

Figure 6:
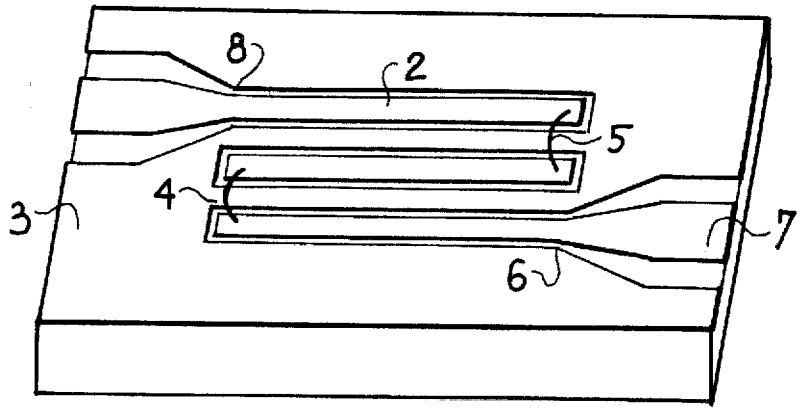
FIG. 6 is a similar view of another coplanar delay line according to my invention.

FIG. 6 shows another embodiment of such a delay line in which the conducting strips 2 are interconnected, alternately at opposite ends, by short-circuiting wires 5 jumping across ground strips 4.

Figure 7:
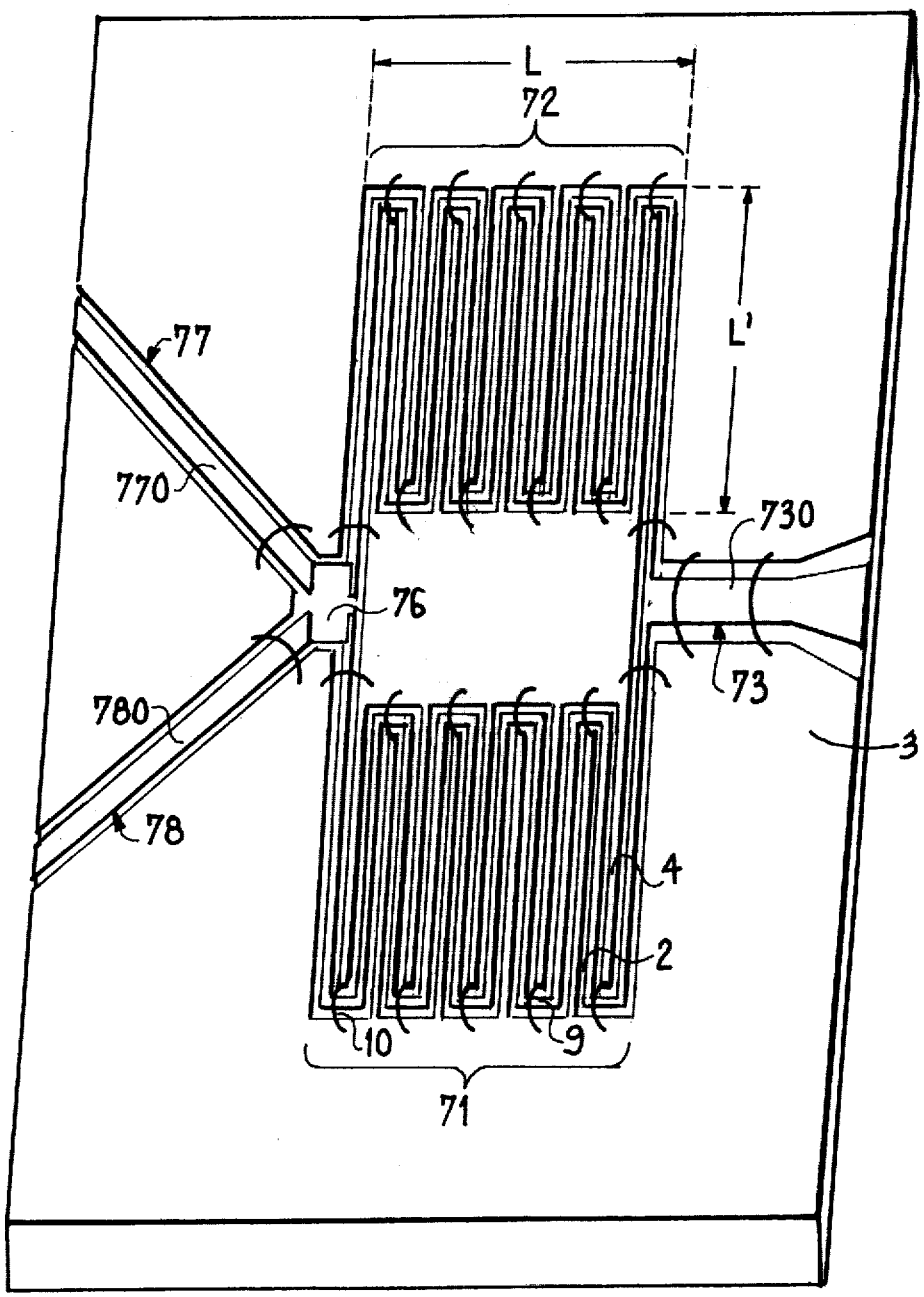
FIG. 7 is a perspective view of a Wilkinson T according to my invention.

FIG. 7 shows a microwave circuit according to my invention designed as a Wilkinson T with an input line 73 of impedance 50Ω and two meandering line branches 71 and 72, of length $\lambda/4$ at the median operating frequency and impedance 70Ω terminating at a resistance 76 of 100Ω permitting matching with two output lines 77, 78 having an impedance of 50Ω. Input line 73 and output lines 77, 78 comprise respective central conductors 730, 770 and 780 each flanked by two zones of the grounded conductor 3 coplanar therewith. The two line branches 71 and 72 of length λ/4 are constituted by conducting strips 2 inserted between ground strips 4 integrally joined at one end to conductor 3. The conducting strips 2 are alternately interconnected at opposite ends by short-circuiting strip sections 9 whereas strips 4 are grounded at their free ends by respective wires 10 jumping across these transverse sections.

In this embodiment, the two meandering line branches 71 and 72 could also be of the form described with reference to FIG. 6.

By way of example, for a central operating frequency of 0.8 GHz, the width of the conducting strips in the Wilkinson T of FIG. 7 is approximately 100μ and the distance between two conducting strips is approximately 110μ, so that the overall dimensions of each section 71 and 72 is L=4.16 mm by L'=4.13 mm.

Figure 8:
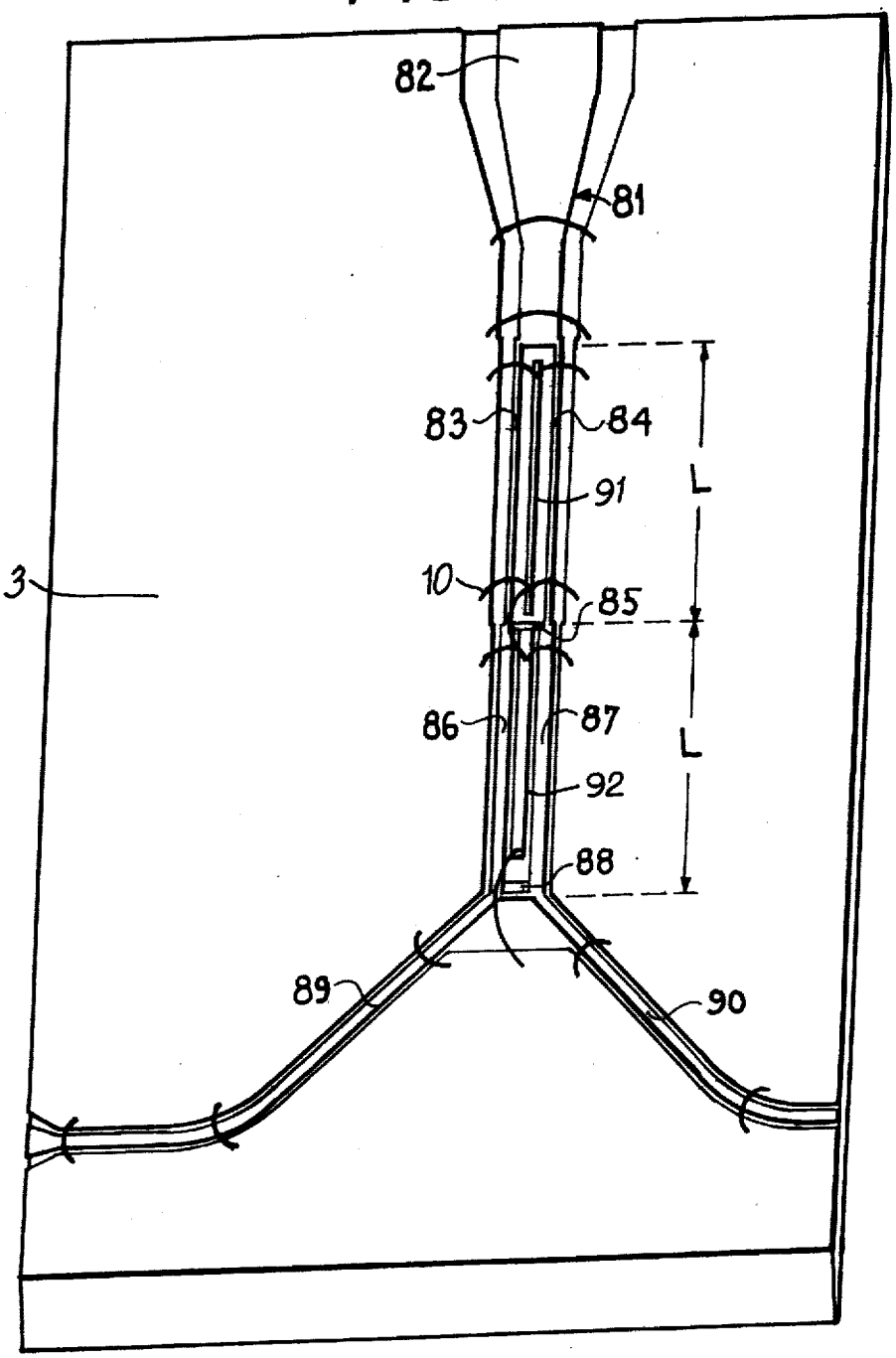
FIG. 8 is a similar view of a dividing T with two sections according to my invention.

FIG. 8 shows another embodiment of a microwave circuit according to my invention in the form of a double-section dividing T. If this coplanar circuitry were produced in some other manner, e.g. by microstrip technology, it would have unduly small dimensions on account of the high central operating frequency. This dividing T has an input 81 in the form of a coplanar line of impedance 50Ω, constituted by a central conductor 82 flanked by two zones of the grounded conductor 3, divided into two coplanar branches 83 and 84 of impedance 80Ω.

The two line branches 83 and 84 are interconnected by a resistor 85 of 76Ω after a distance L equal to a quarter wavelength λ/4 at the median operating frequency of the T. These branches are respectively extended by two coplanar lines 86, 87 of impedance 60Ω which are short-circuited by a resistor 88 of 268Ω after another distance L=λ/4 before being continued by two coplanar output lines 89, 90 of impedance 50Ω. Line strips 83, 84 and 86, 87 bracket respective ground strips 91, 92 each linked at both ends with metal layer 3 by jumpers 10.

By way of example, for a central operating frequency of 14.5 GHz, the width of the conducting strips is between 92 and 155μ and the distance separating them is between 100 and 162μ, the length L being of the order of 2.3 mm.

In all the represented embodiments, one of the advantages of my invention is the availability of circuits of greatly reduced dimensions compared with those produced by three-plate or microstrip technology.

Another advantage of my invention is that of providing weak or strong couplings, depending on whether wide-band or narrow-band filters are to be used, as a result of the interdigitation of the line strips and the grounded conductor.

What is claimed is:

1. A microwave circuit comprising:

a dielectric substrate with a flat face;

a grounded metallic layer on an area of said face;

a multiplicity of conductor strips on another area of said face framed by said layer, said conductor strips being coplanar with said layer and being part of at least one transmission line terminating at an edge of said substrate in an ungrounded central conductor which is flanked by two zones of said layer and coplanar therewith; and at least one ground strip on said face spacedly interleaved with certain of said conductor strips which form part of two parallel line branches terminating in respective output lines, said ground strip having two ends conductively connected to said layer.

2. A microwave circuit as defined in claim 1 wherein said conductor strips are parallel to and substantially coextensive with said ground strip.

3. A microwave circuit as defined in claim 2 wherein said certain of said conductor strips have ends interconnected by a transverse strip section, said ground strip having at least one end connected to said layer by a wire jumping across said transverse strip section.

4. A microwave circuit as defined in claim 2 wherein said ground strip is an integral extension of said layer, said certain of said conductor strips having ends interconnected by a wire jumping across an end portion of said ground strip proximal to said layer.

5. A microwave circuit as defined in claim 1 wherein said line branches are extensions of said ungrounded central conductor and are resistively interconnected at a location remote from said central conductor, said ground strip lying between said central conductor and said location.

6. A microwave circuit as defined in claim 5 wherein said line branches have a length equal to a quarter wavelength of a median operating microwave frequency between said central conductor and said location.

7. A microwave circuit as defined in claim 1, 5 or 6 wherein said central conductor is substantially wider than said conductor strips.

8. A microwave circuit comprising:

a dielectric substrate with a flat face;

a grounded metallic layer on an area of said face; and a multiplicity of conductor strips on another area of said face framed by said layer, said conductor strips being coplanar with said layer and being part of a plurality of mutually coupled transmission lines each including at least one conductor strip spacedly interposed between two bracketing conductor strips of another of said transmission lines, the bracketing strips being conductively interconnected at both ends thereof, said coupled transmission lines meandering around a plurality of ground strips paralleling said conductor strips, said ground strips each having two ends conductively connected to said layer.

9. A microwave circuit as defined in claim 8 wherein at least one pair of ends of said bracketing conductor strips are interconnected by a short-circuiting wire jumping across the interposed conductor strip.

10. A microwave circuit as defined in claim 8 or 9 wherein one pair of ends of said bracketing conductor strips are interconnected by a short-circuiting transverse strip section.

11. A microwave circuit as defined in claim 8 or 9 wherein said other area of said face is a substantially rectangular cutout of said layer, said ground strips extending alternately from opposite edges of said cutout and having free ends connected to said layer by short-circuiting wires jumping across transverse strip sections of said transmission lines.

12. A microwave circuit comprising:

a dielectric substrate with a flat face;

a grounded metallic layer on an area of said face;

a multiplicity of said conductor strips on another area of said face framed by said layer, said conductor strips being coplanar with said layer and being part of at least one transmission line terminating at an edge of said substrate in an ungrounded central conductor which is flanked by two zones of said layer and coplanar therewith; and a plurality of ground strips on said face spacedly interleaved with certain of said conductor strips in parallel and substantially coextensive relationship therewith, said certain of said conductor strips having ends interconnected by transverse strip sections, each of said ground strips having one end integrally joined to said layer and a free opposite end separated from said layer by one of said transverse strip sections, the free end of each of said ground strips being connected to said layer by a respective wire jumping across the intervening transverse strip section.

13. A microwave circuit comprising:

a dielectric substrate with a flat face;

a grounded metallic layer on an area of said face;

a multiplicity of conductor strips on another area of said face framed by said layer, said conductor strips being coplanar with said layer and being part of at least one transmission line terminating at an edge of said substrate in an ungrounded central conductor which is flanked by two zones of said layer and coplanar therewith; and a plurality of ground strips on said face spacedly interleaved with certain of said conductor strips in parallel and substantially coextensive relationship therewith, each of said ground strips being provided with two ends integrally joined to said layer and being interposed between two of said conductor strips, the latter having ends interconnected by a wire jumping across an end portion of the interposed ground strip.

14. A microwave circuit as defined in claim 12 or 13 wherein a group of said conductor strips interleaved with said plurality of ground strips are closely juxtaposed with said layer and are alternately interconnected at opposite ends to form a line meandering around said ground strips.

15. A microwave circuit as defined in claim 14 wherein said line is divided into two meandering branches lying between an input termination and two output terminations each formed by an ungrounded central conductor flanked by two zones of said layer coplanar therewith.

16. A microwave circuit as defined in claim 15 wherein each of said branches has a length equal to a quarter wavelength of a median operating microwave frequency.

* * * * *